US011026486B2

(12) United States Patent
Böing

(10) Patent No.: US 11,026,486 B2
(45) Date of Patent: Jun. 8, 2021

(54) POLE HANDLE

(71) Applicant: LEKISPORT AG, Baar (CH)

(72) Inventor: Tobias Böing, Grossbettlingen (DE)

(73) Assignee: LEKISPORT AG, Baar (CH)

( * ) Notice: Subject to any disclaimer, the term of this patent is extended or adjusted under 35 U.S.C. 154(b) by 0 days.

(21) Appl. No.: 16/489,538

(22) PCT Filed: Mar. 7, 2018

(86) PCT No.: PCT/EP2018/055538

§ 371 (c)(1),
(2) Date: Aug. 28, 2019

(87) PCT Pub. No.: WO2018/166854

PCT Pub. Date: Sep. 20, 2018

(65) Prior Publication Data

US 2020/0069009 A1 Mar. 5, 2020

(30) Foreign Application Priority Data

Mar. 15, 2017 (CH) ..... 00312/17
Apr. 4, 2017 (CH) ..... 00450/17

(51) Int. Cl.
*A63C 11/22* (2006.01)
*A45B 9/02* (2006.01)

(52) U.S. Cl.
CPC ..... *A45B 9/02* (2013.01); *A63C 11/222* (2013.01); *A45B 2009/025* (2013.01); *A45B 2200/055* (2013.01)

(58) Field of Classification Search
CPC ..... A63C 11/222; A63C 11/2224; A63C 11/2228

(Continued)

(56) References Cited

U.S. PATENT DOCUMENTS 3,113,786 A * 12/1963 Phillipson ..... A63C 11/222 280/822
3,560,014 A * 2/1971 Bruckl ..... A63C 11/22 280/821

(Continued)

FOREIGN PATENT DOCUMENTS

CN 202311607 U 7/2012
DE 196 32 718 C2 7/1998

(Continued)

OTHER PUBLICATIONS

International Search Report for PCT/EP2018/055538 dated May 9, 2018 [PCT/ISA/210].

*Primary Examiner* — Jeffrey J Restifo
(74) *Attorney, Agent, or Firm* — Sughrue Mion, PLLC

(57) ABSTRACT

The invention relates to a pole handle (1) for walking poles, trekking poles, alpine ski poles, cross-country ski poles or Nordic walking poles, comprising a length-adjustable hand strap (2), wherein the strap length is fixed using a blocking element arranged in the handle body. A first end of the hand strap is secured in a top section (4*a*) of the handle body (4), wherein a mid-section (2*d*) of the strap is introduced into a recess (6) of the handle body (4), is deflected about a deflection element (11) in the recess (6), and passes downwards out of the handle body as the free second end (2*b*). The blocking element is pressed onto a lower strap section (2*e*) in order to block the adjustability of the length of the hand strap.

26 Claims, 4 Drawing Sheets

(58) Field of Classification Search
USPC ..... 280/821, 822
See application file for complete search history.

(56) References Cited

U.S. PATENT DOCUMENTS

| | | | | | |
|---|---|---|---|---|---|
| 4,005,872 | A * | 2/1977 | Rischert | A63C 11/222 | 280/822 |
| 4,130,293 | A * | 12/1978 | Hinterreiter | A63C 11/222 | 280/822 |
| 4,288,100 | A * | 9/1981 | Aho | A63C 11/222 | 280/821 |
| 4,288,101 | A * | 9/1981 | Aho | A63C 11/222 | 280/821 |
| 4,416,036 | A * | 11/1983 | Aho | A63C 11/222 | 24/136 R |
| 5,758,388 | A * | 6/1998 | Bjerke | A63C 11/222 | 16/110.1 |
| 6,139,060 | A * | 10/2000 | Lenhart | A45B 9/02 | 280/821 |
| 6,264,242 | B1 * | 7/2001 | Lenhart | A45B 9/02 | 280/821 |
| 6,311,370 | B1 * | 11/2001 | Blin | A63C 11/222 | 16/421 |
| 6,325,418 | B1 * | 12/2001 | Lenhart | A63C 11/222 | 280/821 |
| 6,386,588 | B1 * | 5/2002 | Young | A44B 11/12 | 280/821 |
| 6,439,610 | B1 * | 8/2002 | Pronzati | A63C 11/222 | 24/191 |
| 6,851,437 | B1 * | 2/2005 | Lenhart | A63C 11/222 | 135/72 |
| 7,191,495 | B2 * | 3/2007 | Panizza | A63C 11/222 | 16/422 |
| 7,621,564 | B2 * | 11/2009 | Lenhart | A45B 9/02 | 280/819 |
| 7,665,769 | B2 * | 2/2010 | Lenhart | A63C 11/222 | 280/822 |
| 7,891,708 | B2 * | 2/2011 | Panizza | A63C 11/222 | 280/822 |
| 8,006,352 | B2 * | 8/2011 | Roiser | A63C 11/222 | 16/436 |
| 8,579,329 | B2 * | 11/2013 | Lenhart | A63C 11/222 | 280/822 |
| 8,714,172 | B2 * | 5/2014 | Heim | A45B 9/02 | 135/72 |
| 9,027,206 | B2 * | 5/2015 | Guyoton | A63C 11/222 | 16/430 |
| 2003/0042726 | A1 * | 3/2003 | Wang | A63C 11/222 | 280/821 |

FOREIGN PATENT DOCUMENTS

| | | | |
|---|---|---|---|
| DE | 299 06 612 | U1 | 8/2000 |
| DE | 201 14 396 | U1 | 1/2003 |
| DE | 203 11 805 | U1 | 10/2003 |
| EP | 1 118 362 | A2 | 7/2001 |
| EP | 1 491 241 | A1 | 12/2004 |
| EP | 1 819 406 | B1 | 8/2009 |
| WO | 02/34343 | A1 | 5/2002 |

* cited by examiner

POLE HANDLE

CROSS REFERENCE TO RELATED APPLICATIONS

This application is a National Stage of International Application No. PCT/EP2018/055538 filed Mar. 7, 2018, claiming priority based on Switzerland Patent Application No. 00312/17 filed Mar. 15, 2017 and Switzerland Patent Application No. 00450/17 filed Apr. 4, 2017.

TECHNICAL FIELD

The present invention relates to a pole handle, especially for walking poles, trekking poles, alpine ski poles, cross country poles, Nordic Walking poles, with a handle body and with a hand strap, wherein the hand strap is variably adjustable in its length.

PRIOR ART

Walking poles, trekking poles, alpine ski poles, cross country poles, as well as Nordic Walking poles normally comprise, at their upper end, a pole handle, which is grasped by the hand. In order to avoid an inadvertent loss of the pole and in order to transfer the strength of the hand of the user onto the pole, normally a hand strap is fastened to this pole handle, through which the hand is guided prior to grasping the pole handle. Such hand straps normally are adjustable to various hand sizes as well as for the use with or without gloves, by variability of their length. In this sense, a plurality of possibilities exist to variably fasten hand straps to a pole handle.

On the one hand, it is possible to fasten the hand strap with a screw in or on the pole handle, and to provide different positions for screwing it on. However, there are also constructions in which a fastening mechanism is provided, in which, when the strap is pulled upwards, the length of the strap can be changed, and when the strap is pulled downwards, the strap is fixed in terms of its length. Such fastening mechanisms have, among others, the advantage, that for example in case of a fall of the user, and a resulting traction of the strap in the upward direction, the strap is loosened and injuries of the hand, such as for example the skiers' thumb, can be avoided.

Such constructions for example are described in DE 19632718 C2, as well as EP 1118362, U.S. Pat. No. 3,113,786, or DE 29906612 U1. U.S. Pat. No. 3,113,786 discloses a length-adjustable hand strap, wherein the first end of the strap is fastened in the hand grip and the second end can be fastened at the desired length on the outside of the hand grip with a fastening means arranged perpendicular to the pole axis, while the remaining part of the second end of the strap is insertable into the pole tube through the hand grip. EP 1 819 406 discloses such a hand grip with an improved blocking mechanism for the length of use of the strap. Such a hand grip, however, has the disadvantage, that when the hand grip is formed of a soft material, such as e.g. foamed material or cork, the grip material at the place of entry and exit of the hand strap can be worn down quickly due to strain-based abrasion. Existing systems furthermore have the disadvantage of insufficient stability, when the grips are formed of soft material.

SUMMARY OF THE INVENTION

The invention therefore is based, among others, on the object to provide an improved pole handle, which overcomes the disadvantages of the prior art. Especially, a pole handle with a secure blocking mechanism for the strap length shall be provided, which can be easily produced and the grip material of which is shielded from strain by traction and from abrasion by the strap.

The solution to this problem is achieved by a pole handle according to claim 1.

On the pole handle for walking poles, trekking poles, alpine ski poles, cross country ski poles, or Nordic Walking poles, according to the invention, a length-adjustable hand strap is fastened to or on the handle body, respectively. The pole handle according to the invention furthermore comprises a device for blocking and adjusting the length of use of the hand strap. The hand strap comprises an element essentially formed like a band, which forms, between a first, fastened end, and a free, second end of the hand strap, a loop, which surrounds the hand of the user. Therein, the loop is adjustable in its length. The length of the loop becomes adjustable when the hand strap is moved upwards, and fixed by a downward movement, which is described in further detail further below.

The element of the hand strap which is formed like a band is preferably formed of a woven material with a preferred width of 5-25 mm, preferably from a woven band of artificial fibers or natural fibers. Alternatively, the strap can also be thermoplastically molded from a soft plastic material.

The pole handle comprises a handle body with a head section and a grip section. Furthermore, the handle body comprises an opening with a radial first section in the region of the handle head and an axial, second section essentially in the region of the handle body, wherein the axial second section extends into region of the head section. The horizontal first section serves essentially for inserting and fastening the hand strap on the handle body, while the axial, second section essentially serves for receiving an uppermost tube section of a pole tube from below, i.e. the axial, second section of the opening is formed in an open manner towards the lower end of the handle body. In other words, the opening is formed in an open manner, both towards the bottom at the lower end of the handle body and towards the rear in the insertion region of the hand strap, and the axial, second section of the opening of the handle body extends into the first, essentially horizontal section of the opening.

The hand strap on the one hand, or on one side, respectively, comprises a first end, preferably fastened in the head section of the pole body. On the other side, the hand strap first enters with a middle strap section into the opening of the handle body, is then deflected in the opening around a deflection element, and then exits the opening of the handle body towards the bottom as a free second end. In the opening, or in the inside of the head section of the handle body, respectively, a blocking element is arranged, which blocks, in case of strain by traction on the hand strap, especially when it is directed downwardly, the lower strap section which exits the opening of the handle body towards the lower, free second end. In the pole handle according to the invention, the blocking element is mounted in an insertion element, which, at least with an upper head section of the insertion element, is arranged in the opening of the handle body. In the blocking position, the lower strap section is blocked by the blocking element, in that the lower strap section preferably is pressed onto a support surface of the insertion element or onto a support surface on the insertion element, in a blocking manner.

By providing such an insertion element as a separate structural unit, on the one hand the production of the pole handle is simplified, and furthermore the handle material is spared, as the place of strain is moved into the insertion element, which so-to-speak forms a housing for the blocking mechanism.

According to a first preferred embodiment, the insertion element comprises a lower neck section, which adjoins the head section in an axial direction downwards. The neck section of the insertion element is insertable or inserted, respectively, at the upper end of an uppermost pole section of a pole tube in a central opening of the uppermost pole section. The lower axial section of the insertion element, or the neck section of the insertion element, respectively, which projects into the pole handle in an axial direction from below or which is embedded therein, respectively, is essentially cylindrical, and preferably formed in the form of a hollow cylinder, for the purpose of material- and weight economy. Preferably, the neck section is integrally formed with the head section.

The insertion element is arranged and fastened, according to a further preferred embodiment, with its neck section in the uppermost tube section, e.g. press-fitted, glued or mechanically connected in the uppermost tube section. The head section of the insertion element is arranged in the axial opening of the handle body. The handle body therein can additionally be glued or press-fitted onto this head section of the insertion element. The fastening of the insertion element however, mainly is realized by its neck section in the uppermost tube section.

The insertion element preferably comprises a shoulder between the head section having a larger diameter and the neck section having a smaller diameter. This shoulder serves as an upper stop surface for the uppermost tube section.

In an alternative preferred embodiment, the neck section of the insertion element is formed as a sleeve, and the insertion element is being slid or is slid onto the uppermost tube section, respectively. In other words, the insertion element can be sleeved over the upper end of the uppermost tube section or is sleeved thereupon, respectively. The head section of the insertion element comprises, also in this embodiment, in its cavity, the blocking element, which serves for the deflection and the fixing of the length of the hand strap. The neck section is formed as a sleeve, which is suitable and formed to receive the uppermost tube section. The inner diameter of the sleeve preferably is only marginally larger than the external diameter of the uppermost tube section. The insertion element in this embodiment can either be mounted onto the uppermost tube section and preferably be fastened thereto prior to the assembly of the handle body or as a structural unit with a handle body already fastened thereon or a handle sleeve already mounted thereon, respectively. The fastening of the handle body on the insertion element preferably takes place by adhesive bonding. The fastening of the uppermost tube section in the neck section of the insertion element preferably takes place here by press-fitting or adhesive bonding. The length of the insertion element extends in this preferred sleeve-like embodiment preferably via a large part of the length of the handle body, or from the horizontal first section of the opening of the handle body till the lower end of the handle body within and along the entire length of the axial second section of the opening of the handle body, respectively.

Between the head section and the neck section, according to a further preferred embodiment, a separation wall is arranged transversal to the longitudinal pole axis and essentially extending in the radial direction, said separation wall limiting a cavity in the insertion element towards the bottom, or which separates the cavity into an upper central opening and a lower central opening, or which forms the floor of the upper central opening, respectively. This separating wall forms, preferably in the region of the shoulder, the support surface for the lower strap section, against which the lower strap section is pressed in the blocking position.

In the embodiment, in which the insertion element is formed to receive the uppermost tube sleeve, the uppermost tube section finds an upper stop surface on the inner upper end of the sleeve-like neck section of the insertion element. This can be formed as said separation wall or for example as a sleeve section having a smaller diameter compared to the neck section, which forms the boundary to the head section of the insertion element. The upper stop surface for the uppermost tube section therefore can also be formed by a circumferential radial shoulder, which is arranged between the head section and the neck section of the insertion element. Preferably, according to this preferred embodiment, the head section and the neck section of the insertion element are integrally formed.

The insertion element preferably is formed at least partially, preferably entirely of metal, for example of aluminium or an aluminium alloy. As an alternative, the insertion element can however also be partially or entirely formed of plastic, especially of a rigid plastic, preferably of PC, PP, polyamide, or ABS, optionally in a fiber-reinforced form.

The total length of the insertion element, measured along its longitudinal axis, or in a mounted state along the longitudinal pole axis, respectively, or along the longitudinal axis of the handle body, respectively, preferably is 20-70 mm, more preferably 30-60 mm. Therein, the neck portion projecting into the uppermost tube portion preferably has a length of 10-40 mm, more preferably of 20-30 mm. Preferably, the head section of the insertion element is formed longer than the neck section, however, as an alternative, an opposite relation of the length of the head section to the length of the neck section is possible, or it is possible that both sections are essentially of equal length.

The external diameter of the insertion element in the head section preferably is 12-22 mm, more preferably 14-18 mm. The external diameter of the neck section of the insertion element preferably is 10-20 mm, more preferably 12-16 mm.

The head section of the insertion element preferably meets an upper stop surface on an upper wall limiting the second axial opening in the interior of the head section of the handle body. The dimensions of the opening or the hole, respectively, of the handle body for the head section of the insertion element are coordinated with the dimensions of the insertion element.

The upper, first end of the hand strap is advantageously fastened to or on an upper wall of the insertion element by means of a fastening element, preferably by means of a screw, a pin, a bolt, or a rivet. Therein, the fastening element projects in a further preferred embodiment, into a preferably axial central opening or hole in the upper wall of the head section of the insertion element. In case the first end of the hand strap is fastened by a screw, the axial central opening or hole preferably comprises an inner thread.

In the pole handle according to the invention, the lower strap section which exits the handle body with the free lower second end is arranged immediately below the middle strap section entering the grip body.

According to a further preferred embodiment, the deflection element is a pin, which is arranged essentially horizontally in the head section of the insertion element and essentially transverse to a longitudinal axis of the handle body or of the pole attached thereto, respectively. The pin preferably is held or mounted, respectively, in a lateral wall in the region of the head section of the insertion element in corresponding opposite openings or holes in the insertion element, wherein at least one of these two openings is formed on one side as a through hole, such that the pin can be inserted from the outside and thus can be fastened in the insertion element or in the handle body, respectively. This, on the one hand, simplifies the production of the insertion element as a separate structural unit, which can be inserted in the handle head during the initial assembly or in case of replacement, and on the other hand allows, in case of wear of the blocking element or of the hand strap, the replacement of the pin, the blocking element or of the hand strap.

The transverse pin, which serves as a deflection element for the hand strap, therefore projects through an upper central opening of the insertion element in a direction transverse to the longitudinal pole axis and transverse to a direction, in which the middle strap section is inserted into the horizontal section of the opening of the handle body.

The pin or transverse pin, respectively, can have a circular cross-section, however, it is also possible for example to increase the friction, to provide a different cross-sectional form, for example a square-, rectangular-, or polygonal cross-sectional form.

Preferably, the blocking element is fastened to the deflection element formed as a transverse pin in a rotatable or fixed manner. Therefore, the blocking element preferably is arranged in an upper central opening of the insertion element, i.e. in the head region of the insertion element.

The blocking element according to a further preferred embodiment is mounted in a rotatable or pivotable manner around the deflection element or the transverse pin, respectively. The transverse pin is arranged along the pivot axis or rotation axis, respectively, of the blocking element, and the blocking element therefore rotates around the transverse pin. Therefore, preferably the middle strap section entering the handle body is guided around the transverse pin, and guided out of the handle body below with the second free lower end in the region of the horizontal first section of the opening. Alternatively, the blocking element can be fastened in a fixed manner to the transverse pin, wherein the transverse pin is arranged in the opposite openings or holes of the insertion element in a rotatable manner.

A further preferred embodiment is characterized in that the blocking element has a region which is angled downwards or directed towards the bottom, respectively, and which is pressed onto the lower strap section exiting the handle body towards the free, lower, second end in the blocking position. Contrary to the pole handle of EP 1 819 406, here, in the blocking position, only the lower strap section is pressed onto a support surface of the insertion element by the blocking element in a blocking manner.

The blocking element preferably comprises a deflection section, which on the outside is encompassed by the middle strap section with an encompassing angle of at least 120 degrees, preferably of at least 160 degrees. Preferably, a straight section adjoins the deflection section. At the end of the straight section, or leg, which is directed away from the pin, or which is directed towards the entry of the opening on the rear side of the pole handle, respectively, preferably the region which is angled downwards or directed towards the bottom, respectively, as mentioned above, is arranged.

The region of the blocking element which is angled towards the bottom is angled by an angle of 70-120 degrees from the straight section or leg, respectively.

The straight section and the downwardly angled region of the blocking element preferably comprises each a length or height, respectively, such that in case of the hand strap being downwardly directed, the middle strap section which enters the opening of the handle body, pulls the downwardly angled region of the blocking element downwards onto the lower strap section which exits the handle body toward the free end. The downwardly directed traction on the hand strap results in a traction on the deflection section of the blocking element, which results in a rotation of the blocking element and in a resulting application of force of the downwardly angled region of the blocking element onto the lower strap section. It is especially advantageous if the downwardly angled region of the blocking element comprises on its bottom side a downwardly directed toothing, or preferably at least one downwardly directed tooth or a continuous clamping edge. This increases the friction between the blocking element and the lower strap section, as the downwardly directed teeth tightly clamp the strap band when the blocking element is downwardly deflected. In addition, the teeth increase the pressure on the strap band and thereby improve the holding force.

The blocking element is pivoted downwardly around the deflection element in case of a downward movement of the hand strap or in case of a downwards traction on the hand strap, for the purpose of blocking the lower strap section. To the contrary, in case of an upwards movement of the hand strap, the blocking element is pivoted upwards around the deflection element, for the purpose of adjustability of the length of the hand strap, while the lower strap section is released, as the angled region or the angled region of the blocking element, respectively, is either lifted off the lower strap section or the pressure on the lower strap section is at least reduced. The blocking element is held in the blocking position by traction force in the downwards direction. Preferably, an adjustability of the length of the hand strap is only enabled when the hand strap is specifically deflected into a horizontal position, and especially only in case of an upwards movement of the hand strap. The present invention furthermore concerns a pole, especially a walking pole, trekking pole, alpine ski pole, cross-country ski pole, or Nordic Walking pole, which comprises a pole handle according to one of the above described embodiments.

Further embodiments of the invention are laid down in the dependent claims.

BRIEF DESCRIPTION OF THE DRAWINGS

Preferred embodiments of the invention are described in the following with reference to the drawings, which are for the purpose of illustrating the present preferred embodiments of the invention and not for the purpose of limiting the same. In the drawings.

DESCRIPTION OF PREFERRED EMBODIMENTS

Figure 1:
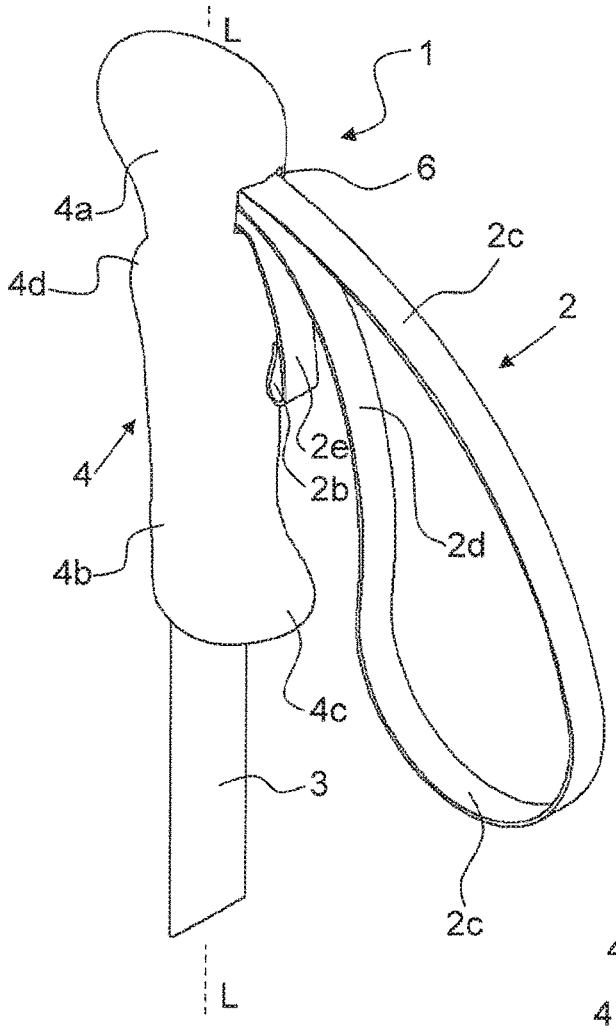
FIG. 1 shows a perspective, schematic view of a pole handle according to a first embodiment on a pole obliquely from the rear left with respect to the direction of walking.
Figure 2:
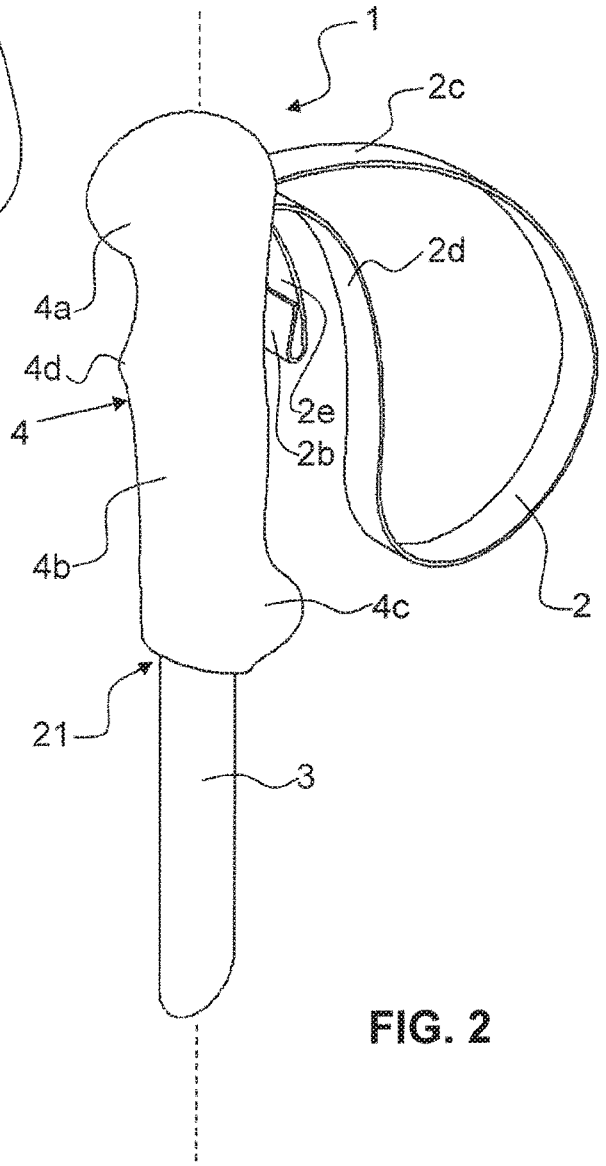
FIG. 2 shows a perspective, schematic view of the pole handle of FIG. 1 obliquely from the front left with respect to the direction of walking.

FIG. 1 is a first embodiment of a pole 1 according to the invention in the blocking position or clamping position, respectively. The handle body 4 of the pole handle 1 is fastened to an upper end of a pole tube, or to an uppermost tube section 3 of a pole tube, respectively. The handle body 4 comprises an upper head section 4*a* and a lower grip section 4*b*. The hand strap 2 fastened in the head section 4*a* of the handle body 4 is formed in a length-adjustable manner. For the purpose of decreasing the diameter of the hand strap 2, the lower, free, second end 2*b* of the strap band of the hand strap 2 must be pulled, wherein the length can only be changed or adjusted, or a traction on the lower, free, second end is only possible, respectively, when the hand strap 2, or the upper strap portion 2*c* which exits the handle head 4*a*, respectively, and the middle strap section 2*d*, which enters into the handle head 4*a* or into the handle body 4*b*, respectively, are moved upwards.

Figures 3, 4:
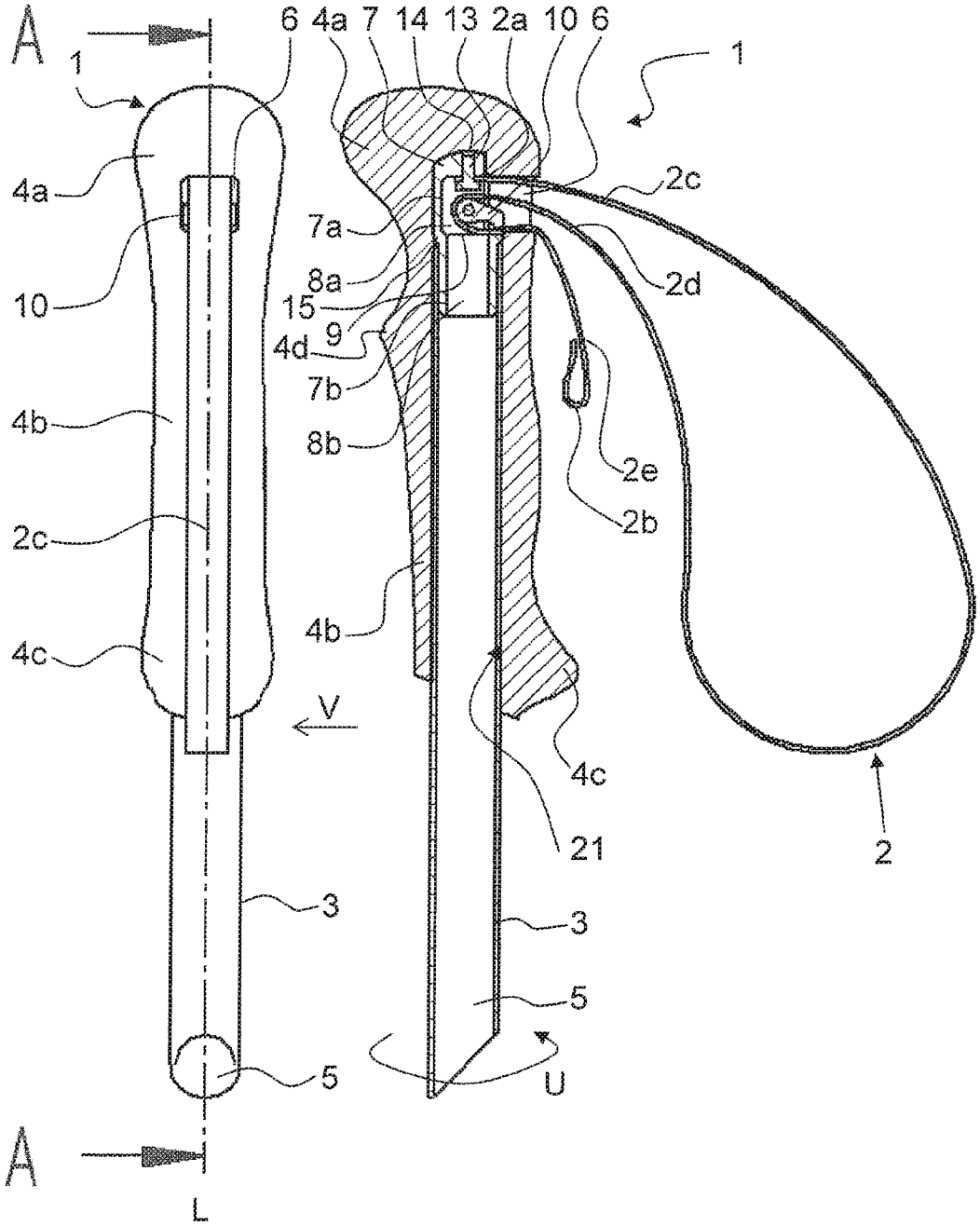
FIG. 3 shows a schematic view of the pole handle of FIG. 1 from the rear with respect to the direction of walking.
FIG. 4 shows a schematic view of the pole handle of FIG. 1 along the section plane A-A of FIG. 3.

As shown in FIG. 4, the handle body 4 comprises an axial opening or an axial cavity 21, respectively, which is open towards the bottom, and into which the pole tube 3 is inserted. The pole handle 1 is formed in an ergonomic manner, wherein the grip section 4*b* of the handle body 4 comprises a forwardly directed shoulder 4*d* in the direction of walking V, for the support of fingers, and a projection 4*c* directed towards the rear at the lower end of the grip section 4*b*. At the upper end of the handle head 4*a*, an overhanging knob is formed in the direction of walking V, which facilitates a user to lean onto the pole from above and to grasp around it.

Furthermore, the handle head 4*a* of the handle body 4 comprises an opening 6, which is formed in an open manner towards the rear side of the pole handle 1, with respect to the direction of walking V, i.e. on the side of the user where the hand strap enters the handle head 4*a*, or exits the handle head 4*a*, respectively. This essentially horizontal opening 6 opens into the central axial opening 21 for the pole tube, or the uppermost tube section 3 of a pole tube.

Figure 5:
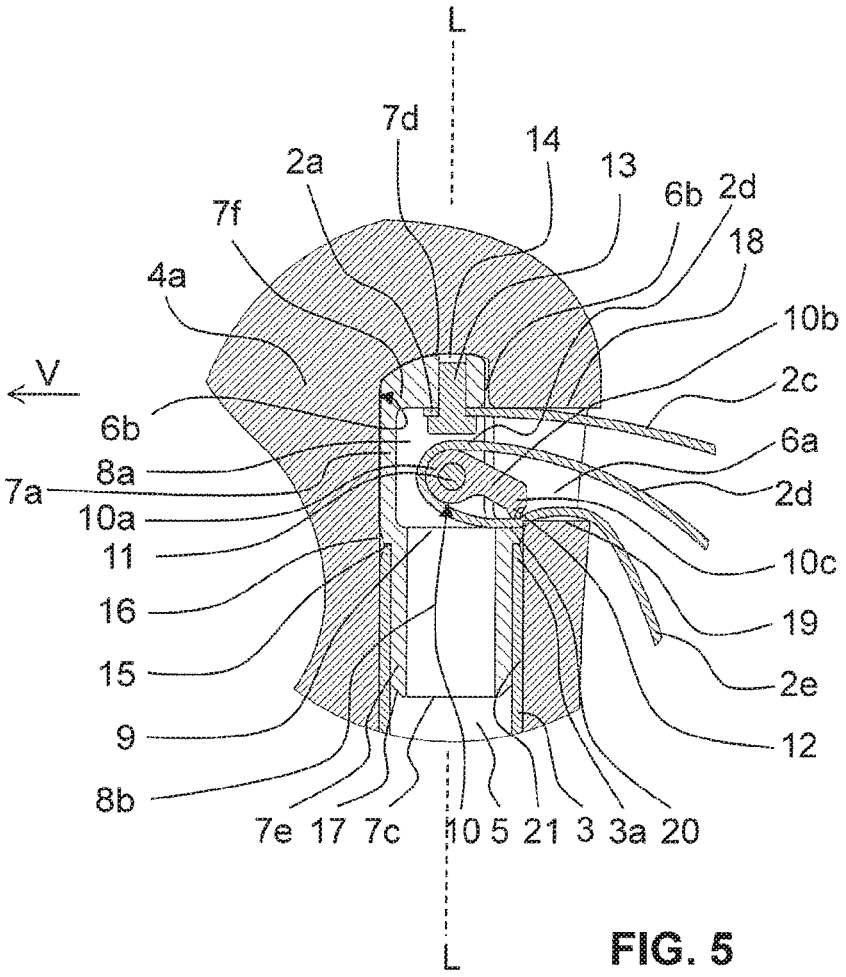
FIG. 5 a detailed view of the section view of the upper section of the pole handle of FIG. 4.

Into the upper end 3*a* of the inserted uppermost tube section 3 of a pole tube, an insertion element 7 is inserted from above in the embodiment according to the invention shown in FIG. 5, said insertion element 7 engaging with its neck section 7*b* in the uppermost tube section 3 of the pole tube. The neck section 7*b* of the insertion element 7 is formed as a hollow cylinder. The head section 7*a* of the insertion element 7 is also formed essentially as a so-to-speak incomplete hollow cylinder, with respect to the circumferential direction U1, with a convex upper wall 7*f* which is open towards the top. The head region 7*a* is formed in a closed manner, with respect to the direction of walking V towards the front in the circumferential direction, however, open towards the rear, i.e. the lateral surface of the head region 7*a* of the insertion element 7 is partially missing in the circumferential direction U1 of the insertion element. Therein, less than the half of the circumference of the lateral surface is missing. The insertion element 7 meets an upper stop surface on the wall limiting the axial opening 21 of the handle head 4*a* towards the top.

Through this opening, the hand strap 2 can project further into the opening 6 of the handle head 4*a* and further into the central opening 8*a* head section 7*a* of the insertion element 7.

A circumferential shoulder 15 formed in the circumferential direction U1 of the insertion element 7 at the transition from the lower neck section 7*b* to the upper head section 7*a* of the insertion element 7, serves as an upper stop surface for the pole tube. Therein, the circumferential lower edge 16 on the shoulder 15 is formed in an inclined manner, as well as the lower, circumferential edge 17 of the neck section 7*b* of the insertion element 7, as shown in detail in FIG. 5.

Between the head section 7*a* and the neck section 7*b* of the insertion element 7, or between the upper central opening 8*a* and the lower central opening 8*b* of the insertion element 7, respectively, according to the embodiment of FIGS. 4, 5, a separation wall 9 is arranged, which so-to-speak forms the floor of the upper central opening 8*a*.

In the head section 7*a* of the insertion element 7 a blocking element 10 is mounted in a rotatable or in a pivotable manner, respectively, about a rotation axis, which is arranged transverse to the longitudinal pole axis L or to the longitudinal axis of the pole handle 1, and transverse to the direction of walking V and essentially horizontal. Along the rotation axis, a pin or transverse pin 11 is arranged, about which the blocking element 10 is arranged in a pivotable manner. The head section 7*a* comprises in its lateral wall or in the lateral surface, respectively, on two opposite sides, each a through opening or an opening which is open at least on one side, respectively, through which one end of the transverse pin 11 projects in each case.

The blocking element 10, which is formed in a wing-like manner, comprises a deflection section 10*a*, as well as a leg or straight section 10*b*, respectively, adjoined thereto, followed by an angled region 10*c*. This angled region 10*c* comprises, on its bottom side, small teeth 12 which are directed downwards, or a toothing or a continuous clamping edge, respectively, in order to increase the friction force or the blocking force, respectively, of the blocking element 10 onto the lower strap section 2*e*.

The deflection section 10*a*, as well as the straight section 10*b* and the angled region 10*c* extend over the entire inner diameter of the head section 7*a* of the insertion element 7, or projects through the upper, central opening of the insertion element 7 in a direction parallel to a longitudinal axis of the transverse pin 11, or in a direction transverse to the longitudinal pole axis L, respectively.

The pin or transverse pin 11, respectively, simultaneously serves as a deflection element for the middle strap portion 2*d* of the hand strap 2 in the interior of the handle head 4*a*, or in the interior of the upper central opening 8*a* of the insertion element, respectively. The hand strap 2 comprises a strap band with two free ends 2*a*, 2*b*, whereof an upper first end 2*a* is fastened by means of a fastening element 13 in an upper wall 7*f* of the insertion element 7. For the fastening, the upper wall 7*f* of the head section 7*a* of the insertion element 7 comprises an axial central opening or hole 14. The upper, first end 2*a* of the hand strap 2 takes place by the insertion of the fastening element 13 in the form of a pin, a rivet, or a screw into this central opening or hole 14.

Starting from the fastened upper first end 2*a*, the strap band runs through the essentially horizontal opening of the handle head 4*a* with respect to the direction of walking V towards the rear and exits the handle head 4*a* at the rear side of the pole handle 1. From there, the strap band forms a hand strap 2, which surrounds the hand of the user, and then enters into the opening 6 of the handle head 4*a* again with a middle strap section 2*d*. There, it then enters into the upper central opening 8*a* of the insertion element 7 and is deflected around the pin or transverse pin 11, respectively, which is mounted essentially horizontally in the insertion element 7, or around the blocking element 10, which is mounted in a rotatable manner about the transverse pin 11, respectively. After the deflection, the now lower strap section 2*e* first lies on top of the support surface 20 formed at least in some regions by the separation wall 9, before the lower strap section 2*e* leaves the handle head 4*a* again through the opening 6 towards the rear. The lower, free second end 2*b* of the strap band hangs down free towards the bottom and is formed in a deflected manner in the embodiment shown.

In the embodiment shown, the angled region 10*c* of the blocking element 10 presses the lower strap section 2*e* onto the separation wall 9, or onto the support surface 20 in the region of the shoulder 15 between the head section 7*a* and the neck section 7*b* of the insertion element 7, respectively. The pressure mark is located in the region of the lateral wall or of the lateral surface at the lower end of the head section 7*a* of the insertion element 7, immediately before the contact point between the insertion element and the rear wall of the handle body 4 at the lower end of the radial first section 6*a* of the opening 6.

The hand strap of FIG. 4 is shown in a so-to-speak neutral position, i.e. neither in a position, in which it is pulled downwards, in which the blocking element 10 is in a clamping position or blocking position, respectively, nor in a position, in which it is pulled upwards, in which the blocking element 10 is in an adjusting position, i.e. in which the hand strap 2 is length-adjustable, but in a position in between. Thus, in the blocking position, the middle strap section 2*d* lies immediately on top of the lower strap section 2*e* at the rear exit of the opening 6.

If the hand strap 2 is directed downwards, which however is not shown in the figures, as it is typically the case when using the pole, or when the hand strap 2 is pulled downwards, respectively, the middle strap section 2*d* pulls on the deflection section 10*a* of the blocking element 10 in clockwise direction U2. By the traction of the middle strap section 2*d* the blocking element 10 is rotated about the transverse pin 11 or around the rotation axis, respectively, due to the enclosure of the deflection section 10*a* of the blocking element 10 by the middle strap section 2*d*. Thereby, the angled region 10*c* of the blocking element 10 is pressed onto the lower strap section 2*e*, which in turn thereby is pressed onto the support surface 20 in the region of the lateral wall in the region of the shoulder 15 of the insertion element 7. Thereby, the length of the hand strap 2 is fixed and the adjustability of the length is prevented in this position. Here, the toothing 12 or spikes on the bottom side of the angled region 10*c* increase the friction force or the blocking effect, respectively.

If the hand strap 2 is held in a horizontal position or directed upwards, the blocking element 10 is easily pivotable and does not exert any pressure on the underlying lower strap section 2*e*. Accordingly, the length of the hand strap 2 can be adjusted in this position, in other words, the hand strap 2 can be shortened by pulling the second, free end 2*b*, or lengthened by pulling the middle strap section 2*d* which enters into the handle body 4. Furthermore, the length of the hand strap 2 can in any case be increased when the hand strap 2 is in a position directed upwards, which automatically results in a safety in case of a fall or in case the pole gets caught.

Figure 6:
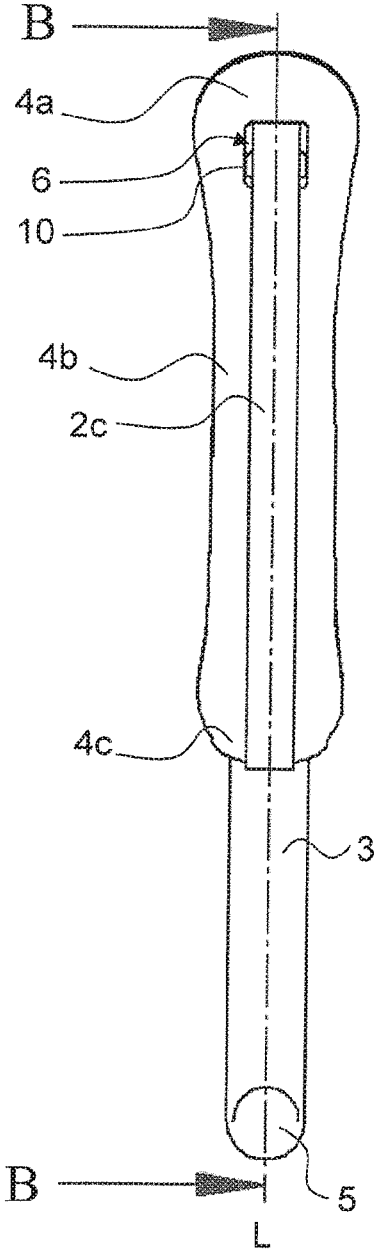
FIG. 6 a schematic view of a pole handle according to a second embodiment on a pole, from the rear with respect to the direction of walking.
Figure 7:
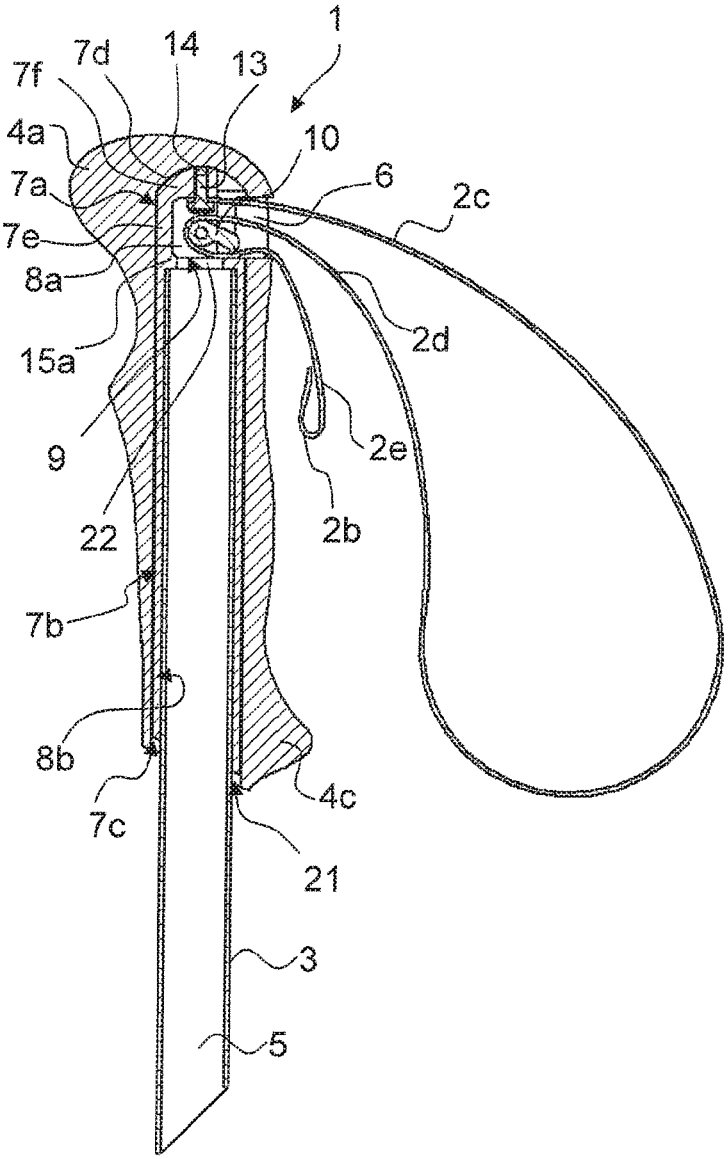
FIG. 7 a schematic section view of the pole handle of FIG. 6 along the section plane B-B of FIG. 6.

In FIG. 6, a second embodiment of a pole handle is shown in a schematic view in the direction of walking from rear to front, with view onto the opening 6 of the head section 4*a* of the handle body 4. The section along the section plane B-B of FIG. 6 is shown in FIG. 7. Here, it can be recognized that the insertion element 7 is formed longer than in the embodiment of FIG. 4. Instead of the insertion element 7 being inserted in the uppermost tube section 3 with its neck section 7*b*, as shown in FIG. 4, in this embodiment, the insertion element 7 is placed onto or sleeved onto, respectively, the uppermost tube section 3 and fastened thereto in the region of its neck section 7*b* which is formed as a sleeve. The uppermost tube section 3 therefore extends within the lower central opening 8*b* of the insertion element 7 over the entire length of the neck section 7*b* and beyond. Furthermore, the neck section 7*b* of the insertion element 7 is received in the central axial opening 21 of the handle body 4, and therefore fastened in the interior of the grip body 4 on the grip body 4. Thereby, the insertion element 7 can either be produced as a structural unit with the handle body 4 and/or as a structural unit with the uppermost tube section 3. The wall thickness of the insertion 7 in the neck section 7*b* is larger in this embodiment than the wall thickness of the uppermost tube section 3.

While in the embodiment of FIG. 4, the upper central opening 8*a* of the insertion element 7 has a larger diameter in its head section 7*a* than the lower central opening 8*b* in its neck section 7*b*, in the embodiment of FIG. 7, the upper central opening 8*a* of the insertion element 7 has a smaller diameter in its head section 7*a* than the lower central opening 8*b* has in its neck section 7*b*. Accordingly, between the head section 7*a* and the neck section 7*b* a radially, inwardly directed, circumferential shoulder 15*a* which extends along the entire circumference of the insertion element 7, or a section with a smaller diameter, respectively, is arranged. This forms an upper stop surface for the uppermost tube section 3 on the upper end of the neck section 7*b*. In the embodiment shown, an essentially disc-like hollow or filled radial cavity 22 is arranged below the separation wall 9 or the floor 9, respectively, in the region of the circumferential shoulder 15*a*.

As in the embodiment of FIG. 4, also in the embodiment of FIG. 7 the blocking element 10 is arranged and fastened in the upper central opening 8*a* in the head section 7*a* of the insertion element 7, wherein the types of arrangement and fastening of the blocking element 10 as well as the types of fastening of the hand strap 2 on the insertion element are also applicable to this alternative embodiment of FIG. 7.

LIST OF REFERENCE SIGNS

| | |
|---|---|
| 1 | pole handle |
| 2 | hand strap |
| 2a | first, upper end of 2 |
| 2b | second, lower end of 2 |
| 2c | upper strap section of 2 |
| 2d | middle section of 2 |
| 2e | lower strap section of 2 |
| 3 | uppermost tube section, pole tube |
| 3a | upper end of 3 |
| 4 | handle body |
| 4a | head section of 4 |
| 4b | grip section of 4 |
| 4c | rear projection of 4 |
| 4d | front shoulder of 4 |
| 5 | cavity, central opening of 3 |
| 6 | opening of 4 in 4a |
| 6a | horizontal first section of 6 |
| 6b | axial second section of 6 |
| 7 | insertion element |
| 7a | head section of 7 |
| 7b | neck section of 7 |
| 7c | lower end of 7 |
| 7d | upper end of 7 |
| 7e | lateral wall of 7 |

-continued

| LIST OF REFERENCE SIGNS | |
|---|---|
| 7f | upper wall of 7 |
| 8a | upper central opening of 7 |
| 8b | lower central opening of 7 |
| 9 | separation wall of 7, floor of 8a |
| 10 | blocking element |
| 10a | deflection section of 10 |
| 10b | straight section, leg of 10 |
| 10c | angled region of 10 |
| 11 | deflection element, transverse pin of 10 |
| 12 | toothing of 10 on 10c |
| 13 | fastening element for 2a |
| 14 | axial, central opening in 7f |
| 15 | shoulder on 7 between 7a, 7b in FIG. 4 |
| 15a | radial shoulder on 7 between 7a, 7b in FIG. 7 |
| 16 | circumferential inclined edge of 7 on 15 |
| 17 | circumferential inclined edge of 7 on 7c |
| 18 | upper limitation of 6a |
| 19 | lower limitation of 6a |
| 20 | support surface of 7 |
| 21 | central, axial opening of 4 for 3 |
| 22 | space at 15a between 7a, 7b |
| L | longitudinal pole axis |
| U | circumferential direction |
| V | forwards, direction of walking |

The invention claimed is:

1. A pole handle for walking poles, trekking poles, alpine ski poles, cross country ski poles or Nordic Walking poles, with a length-adjustable hand strap, comprising:

a handle body with a head section and a grip section, wherein the hand strap is fastened with a device for blocking and adjusting the length of the hand strap on the handle body for use, wherein the handle body comprises an opening with a radial first section and an axial second section, and wherein the hand strap comprises a first end, and enters into the opening of the handle body with a middle strap section, experiences a deflection around a deflection element and exits the opening towards the bottom as a free second end, wherein in the opening a blocking element is arranged, which, when the hand strap is directed downwards, blocks a lower strap section which exits from the opening towards the lower, free, second end, wherein the blocking element is mounted in an insertion element, which is arranged with an upper head section in the opening of the handle body, wherein the middle strap section which enters the handle body is guided around a pin, which is arranged essentially horizontally in the opening of the head section of the handle body and is mounted in the lateral wall of the insertion element in corresponding openings, wherein said middle strap section is guided out of the opening of the handle body towards the bottom as a second, free lower end, wherein the blocking element comprises a deflection section which is encompassed with an encompassing angle of at least 120 degrees on the outside by the middle strap section, and wherein the blocking element comprises a straight section which adjoins the deflection section, said straight section having an end which is directed away from the pin and which comprises a downwards angled region.

2. The pole handle according to claim 1, wherein in a blocking position, the lower strap section is pressed by the blocking element in a blocking manner onto a support surface of the insertion element.

3. The pole handle according to claim 1, wherein the first end of the hand strap is fastened in the head section of the handle body.

4. The pole handle according to claim 1, wherein the insertion element comprises a lower neck section, which adjoins the upper head section in an axial direction downwards.

5. The pole handle according to claim 1, wherein the upper, first end of the hand strap is fastened on or in an upper wall of the insertion element by means of a fastening element.

6. The pole handle according to claim 1, wherein the blocking element is mounted in a rotatable or pivotable manner around the deflection element.

7. The pole handle according to claim 1, wherein the blocking element comprises an angled region or a downwards directed region, which in the blocking position is pressed onto the lower strap section which exits the handle body towards the free lower second end.

8. The pole handle according to claim 1, wherein the straight section and the angled region of the blocking element each have a length or height, respectively, such that when the hand strap is directed downwards, the middle strap section which enters into the opening of the handle body presses the angled region of the blocking element downwards onto the lower strap section which exits the handle body towards the free end.

9. The pole handle according to claim 1, wherein the insertion element is formed of metal or of a plastic material.

10. The pole handle according to claim 9, wherein the insertion element is formed of one of the following: aluminium, an aluminium alloy, PC, PP, polyamide, ABS.

11. The pole handle according to claim 1, wherein the blocking element is held in the blocking position via traction force, and only allows an adjustability of the length of the hand strap upon relief of the strain or upon selective upwards deflection of the hand strap.

12. The pole handle according to claim 1, wherein the blocking element is arranged in an upper central opening of the insertion element, wherein the blocking element is fastened in a rotatable or fixed manner on the deflection element formed as a transverse pin, wherein the transverse pin protrudes the upper central opening of the insertion element in a direction transverse to the longitudinal pole axis and transverse to an insertion direction of the middle strap section into the opening of the handle body, and wherein the transverse pin is mounted on both sides in a wall of the upper head section of the insertion element.

13. The pole handle according to claim 1, wherein the blocking element is pivoted downwards around the deflection element during a downwards movement of the hand strap, for the purpose of blocking the lower strap section, and wherein the blocking element is pivoted upwards around the deflection element during an upwards movement of the hand strap, resulting in a release of the lower strap section, for the purpose of enabling adjustability of the length of the hand strap.

14. The pole handle according to claim 1, wherein the lower neck section is formed as a hollow cylinder, wherein the lower neck section is insertable or inserted at the upper end of an uppermost tube section of a pole tube in a central opening of the uppermost tube section, or which is slidable onto or slid onto the uppermost tube section, and wherein the insertion element comprises, between the upper head section and the lower neck section, a shoulder, which serves as an upper stop surface for the uppermost tube section.

15. The pole handle according to claim 1, wherein between the upper head section and the lower neck section a separation wall is arranged transverse to the longitudinal pole axis and extending essentially in a radial direction, and wherein the separation wall forms, at least partially, the support surface for the lower strap section, against which the lower strap section is pressed in the blocking position.

16. The pole handle according to claim 1, wherein the blocking element, at a bottom side of the angled region of the blocking element comprises a toothing.

17. A pole comprising a pole grip according to claim 1.

18. The pole according to claim 17, in the form of a walking pole, trekking pole, alpine ski pole, cross country ski pole, or Nordic Walking pole.

19. A pole handle for walking poles, trekking poles, alpine ski poles, cross country ski poles or Nordic walking poles, with a length-adjustable hand strap, comprising:

a handle body with a head section and a grip section, wherein the hand strap is fastened with a device for blocking and adjusting the length of the hand strap on the handle body for use, wherein the handle body comprises an opening with a radial first section and an axial second section, wherein the hand strap comprises a first end and enters into the opening of the handle body with a middle strap section, experiences a deflection around a deflection element and exits the opening towards the bottom as a free second end, wherein in the opening a blocking element is arranged, which, when the hand strap is directed downwards, blocks a lower strap section which exits from the opening towards the lower, free second end, wherein the blocking element is mounted in an insertion element, which is arranged with an upper head section in the opening of the handle body, wherein the insertion element comprises a lower neck section, which adjoins the upper head section in an axial direction downwards, wherein between the upper head section and the lower neck section a separation wall is arranged transverse to the longitudinal pole axis and extending essentially in a radial direction, and wherein the separation wall forms, at least partially, the support surface for the lower strap section, against which the lower strap section is pressed in the blocking position.

20. A pole, comprising a pole grip according to claim 19.

21. The pole according to claim 20, in the form of a walking pole, trekking pole, alpine ski pole, cross country ski pole, or Nordic Walking pole.

22. A pole handle for walking poles, trekking poles, alpine ski poles, cross country ski poles or Nordic Walking poles, with a length-adjustable hand strap, comprising:

a handle body with a head section and a grip section, wherein the hand strap is fastened with a device for blocking and adjusting the length of the hand strap on the handle body for use, wherein the handle body comprises an opening with a radial first section and an axial second section, wherein the hand strap comprises a first end, and enters into the opening of the handle body with a middle strap section, experiences a deflection around a deflection element and exits the opening towards the bottom as a free second end, wherein in the opening a blocking element is arranged, which, when the hand strap is directed downwards, blocks the lower strap section which exits from the opening towards the lower, free, second end, wherein the blocking element is mounted in an insertion element, which is arranged with an upper head section in the opening of the handle body, and wherein the blocking element, especially at a bottom side of an angled region of the blocking element, comprises a toothing.

23. The pole handle according to claim 22, wherein the deflection element is a pin, which is arranged essentially transverse to a longitudinal axis of the handle body, and which is mounted in a lateral wall of the insertion element in corresponding openings.

24. The pole handle according to claim 23, wherein the corresponding openings are formed as through openings at least on one side.

25. A pole comprising a pole grip according to claim 22.

26. The pole according to claim 25, in the form of a walking pole, trekking pole, alpine ski pole, cross country ski pole, or Nordic Walking pole.

* * * * *